US005709253A

United States Patent [19]

Maerzke

[11] Patent Number: 5,709,253

[45] Date of Patent: Jan. 20, 1998

[54] METHOD FOR REFILLING AN INKJET CARTRIDGE AND APPARATUS TO MODIFY A CARTRIDGE WITH A NEGATIVE PRESSURE RESERVOIR

[75] Inventor: James T. Maerzke, Kenosha, Wis.

[73] Assignee: Procubed Corporation, Kenosha, Wis.

[21] Appl. No.: 689,031

[22] Filed: Jul. 30, 1996

[51] Int. Cl.[6] ..... B65B 1/04

[52] U.S. Cl. ..... 141/18; 141/2; 141/8; 141/27; 347/85

[58] Field of Search ..... 141/2, 4, 5, 7, 141/8, 18, 20.5, 23–27, 98; 53/432, 510; 347/85, 86, 87

[56] References Cited

U.S. PATENT DOCUMENTS

| | | | |
|---|---|---|---|
| 5,199,470 | 4/1993 | Goldman | 141/1 |
| 5,280,300 | 1/1994 | Fong et al. | 141/2 |
| 5,329,294 | 7/1994 | Ontawar et al. | 397/87 |
| 5,515,663 | 5/1996 | Allgeier, Sr. et al. | 347/87 |
| 5,537,124 | 7/1996 | Baldwin et al. | 347/85 |

*Primary Examiner*—Henry J. Recla
*Assistant Examiner*—Steven O. Douglas

[57] ABSTRACT

A method for refilling an inkjet cartridge such that there is little or no ink leakage. Turning the cartridge upside-down, the ink reservoir vent, on the base of the cartridge, is held facing up, allows air to vent, while the ink is dispensed into the cartridge at the opposing end of the reservoir. The components used to perform the refill operation are tapered fittings that securely lock together and make a tight seal on the fill port of the cartridge so that ink will not spill out during the filling operation. Once the cartridge has been refilled, a negative pressure reservoir is provided to create and maintain a negative pressure, or vacuum, required to keep the printer cartridge operational until it exhausts its supply of ink. The negative pressure reservoir (n.p.r.) is connected to the fill port of the cartridge, with out the need to displace or remove any ink from the cartridge. The n.p.r. is removable in order to repeat the refill procedure as many times as allowed by the performance of the printhead.

3 Claims, 6 Drawing Sheets

METHOD FOR REFILLING AN INKJET CARTRIDGE AND APPARATUS TO MODIFY A CARTRIDGE WITH A NEGATIVE PRESSURE RESERVOIR

BACKGROUND OF THE INVENTION

The invention relates to an improved method for refilling an ink cartridge used with ink jet printers, and a modification to said cartridge to create and help sustain the required negative pressure of the ink reservoir. The method employs tapered fittings which securely seal to the fill port of a cartridge so that ink does not leak out from the connection during the filling operation. In holding the cartridge so that the reservoir vent, on the base of a cartridge, is faced upward, excess internal pressure generated, while filling, is released, reducing the possibility of ink leakage. The apparatus of the current invention consists of a negative pressure reservoir (n.p.r.) that is connected to the fill port of a cartridge and is secured to the exterior of a cartridge. A negative pressure reservoir creates and helps to sustain the required negative pressure, or vacuum, inside a cartridge ink reservoir, thus permitting the intended use of a print cartridge.

U.S. Pat. No. 5,537,134 to Marc A. Baldwin, et al., has a prior art described for refilling an ink cartridge whereby the reservoir vent at the base of the cartridge is sealed prior to filling. The only apparent means of venting is around the nozzle used to fill the ink reservoir, or by allowing ink to discharge from the printhead. After refilling, creating the negative pressure in the ink reservoir is somewhat complicated and messy. Both the vent and the printhead nozzles are sealed, the bladders inside the ink reservoir are inflated, and the ink reservoir is then closed and the bladders are re-opened to ambient air. Another means to create the negative pressure in the Baldwin patent is by using apparatus that is attached to the top of the cartridge at the fill port, a pump evacuates a volume of air and/or ink, and the port is resealed. The apparatus is then removed from the cartridge.

U.S. Pat. No. 5,329,294 to Susan P. Ontawar et al. has a prior art device described for making a refillable ink jet cartridge and method for refilling said cartridge. Similar methods to the aforementioned prior art are used to fill and then create the necessary negative pressure. This art uses a squeeze bottle to inflate the bladders. A similar approach of sealing the vent is used, as well as allowing ink to drip from the printhead. These do not appear to be the most clean or efficient means of performing the refill procedure.

The ink cartridge is one of the more expensive consumables needed for the operation of ink jet printers, obviously because the ink is constantly used and must therefore be replaced. Before the inventions mentioned above, a new, pre-filled cartridge was commercially purchased to replace a cartridge that ran out of ink. However, rather than replace the entire cartridge, it is more economical and environmentally sound to simply replace the ink. Refilling of inkier cartridges has become a standard practice in the field of printing mechanisms. Although cartridges will still need to be replaced occasionally, due to the life of the printhead, it is not as often an occurrence when using ink refilling methods.

A common inefficiency with present methods for refilling ink cartridges of this type, is the leakage of ink during the refill process. As a cartridge is being filled, the pressure inside the ink reservoir increases. Without a means of venting, the ink will tend to 'drool' from an orifice where available, such as the nozzles of the printhead, or the reservoir vent. Most procedures instruct the user to fill from the port with a small diameter tube or needle and hold the cartridge so that the fill port is in the upright position. Venting may occur from around the filling tube, but it is often not adequate to overcome the increasing pressure. Therefore, leaking or drooling occurs and it becomes necessary to perform the procedure over an absorbent pad to catch the dripping ink. Alternate methods include sealing orifices where ink may drip out, which disallows venting to take place and possibly not achieving complete fill of the cartridge reservoir. In addition, it is often required to remove or displace an amount of ink in order to obtain the required negative pressure inside the cartridge ink reservoir. This can be costly, as well as messy, because ink is being wasted as it spills out.

Therefore, an object of this invention is to provide an improved method for the process of refilling an ink cartridge, and apparatus to modify a cartridge with an external negative pressure reservoir. Another object of this invention is to perform the refilling operation such that the ink reservoir vent is held facing upward, allowing the increasing internal pressure to vent air and reduce or eliminate the occurrence of ink leaking. Yet another object of this invention is to provide tapered fittings for a leak resistant filling operation. Still another object of this invention is an external negative pressure reservoir (n.p.r.) which creates and helps to sustain the required negative pressure (or vacuum) inside the cartridge without having to displace or remove any ink.

SUMMARY OF THE INVENTION

The improved method of refilling inkjet cartridges combines the use of tapered fittings for a tight seal on the fill port of a cartridge, with the position the cartridge held, to allow venting during the filling process. The apparatus to modify an inkjet cartridge is secured to the outer wall of a cartridge and helps to sustain the negative pressure required for the intended operation of the cartridge.

The advantage and object of the improved refill method and modification is the method used to refill a cartridge, whereby the cartridge is held upside-down, with the reservoir vent faced up, to allow pressure to vent during the filling operation. Also the method includes the use of tapered fittings that seal tightly to the fill port for clean, efficient filling. In addition, the apparatus to modify the cartridge comprises a small open cell reticulated plastic foam material, sealed in a flexible non air permeable skin forming an outer bag, a small diameter tube, sealed into the bag and connected to a reservoir adapter, which is inserted into the fill port of the cartridge. The size, shape and material of the negative pressure reservoir assembly is calculated to meet the performance specifications relative to the approximate size and volume of an inkjet cartridge. This assembly is used to create the negative pressure required by compressing the foam inside the bag and connecting it to the ink reservoir fill port. There is no need to displace or remove ink to create the internal vacuum, thereby reducing spillage and waste of ink.

DETAILED DESCRIPTION OF DRAWINGS

Figure 1:
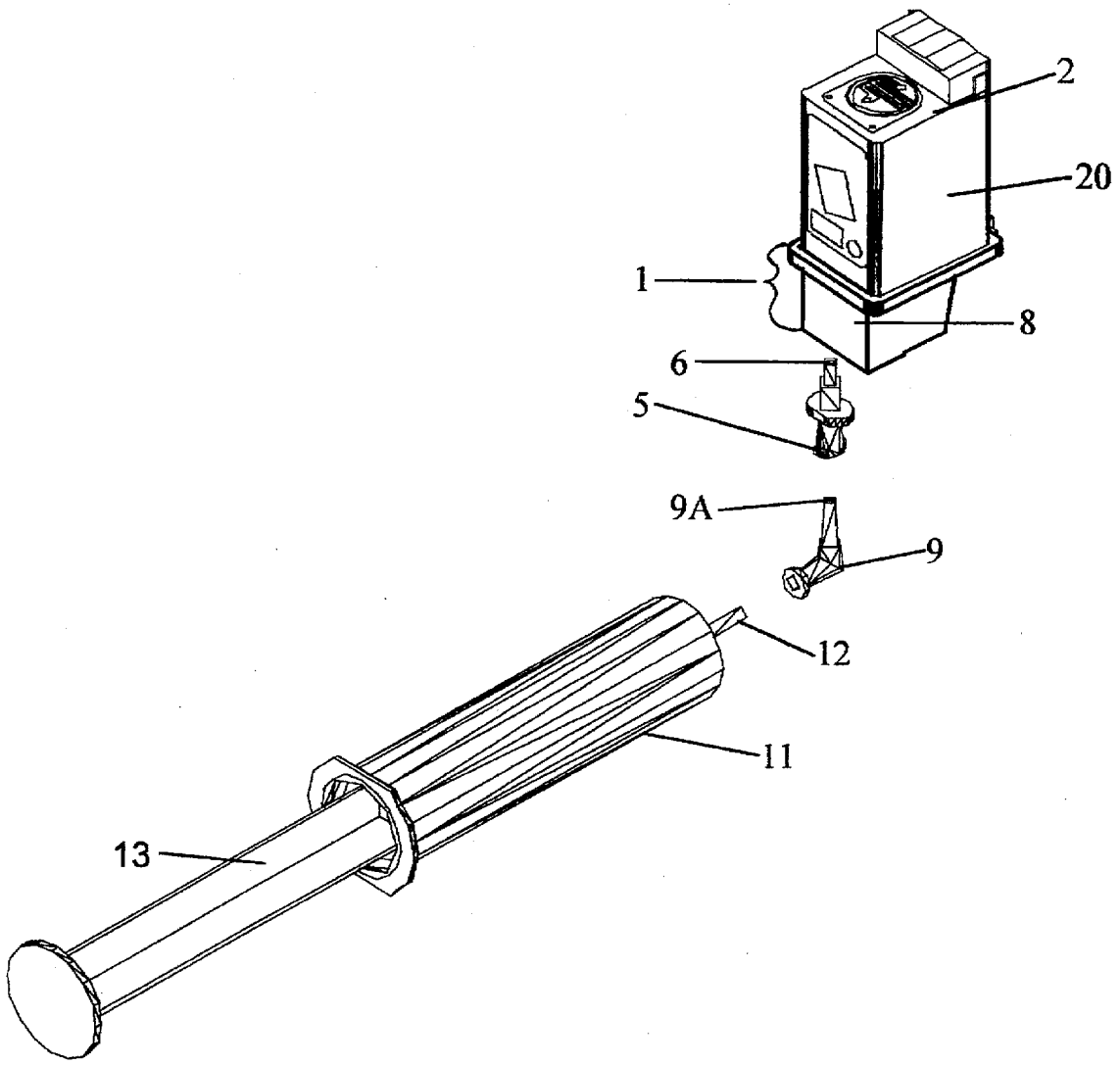
FIG. 1 is a perspective view of the placement of tapered fittings and syringe into a cartridge for the improved seal to the fill port.

In FIG. 1 the components are shown as they are placed in the cartridge fill port. The top section 1 of a cartridge 20 comprises a fill port 3. With the fill port 3 in the upright position, the tapered luer 6 of a fill adapter 5 is pushed into the fill port 3 until it is fittingly secure, making a sealed connection 7 (See FIG. 2). Inserting a fill adapter in this manner will open the ink reservoir to accommodate filling. Therefore, it must be held upright. Lying the cartridge down on its front face, (the plane adjacent to the printhead of the cartridge,) the tapered luer 9A of an elbow connector 9 is inserted into the open end of fill adapter 5, such that the open end of elbow 9 points upward (on the same plane as the back face 8 of the top section 1,) using enough pressure to secure a sealed connection 10 (See FIG. 2). A syringe 11, filled with ink (not shown) is then connected by inserting the tapered luer 12 of a syringe 11 into the open end of the elbow 9 and using pressure to secure a sealed fit.

Figure 2:
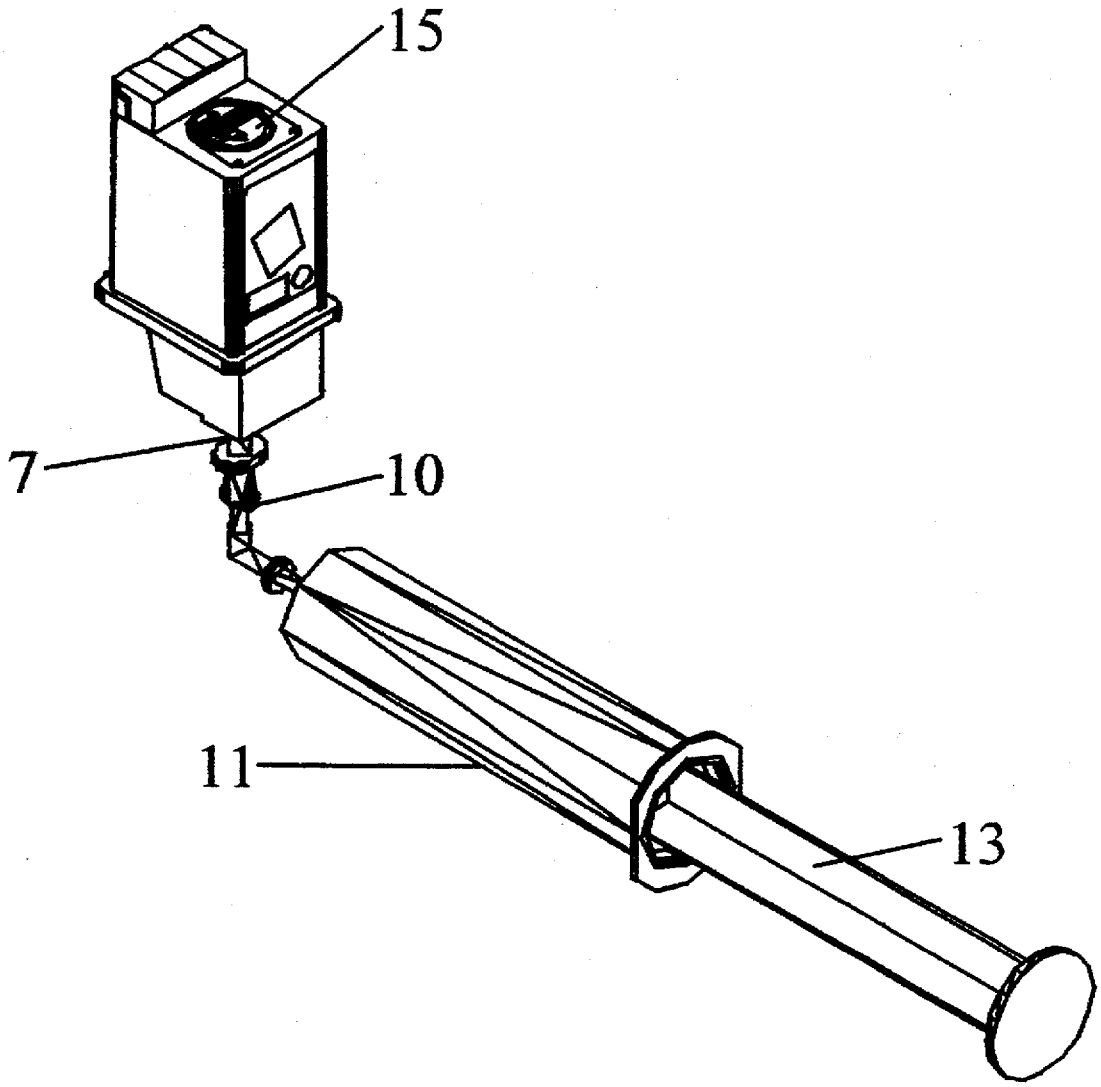
FIG. 2 is the preferred assembly of filling apparatus, and position of a cartridge, vent faced upward, for the refilling procedure.
Figure 3:
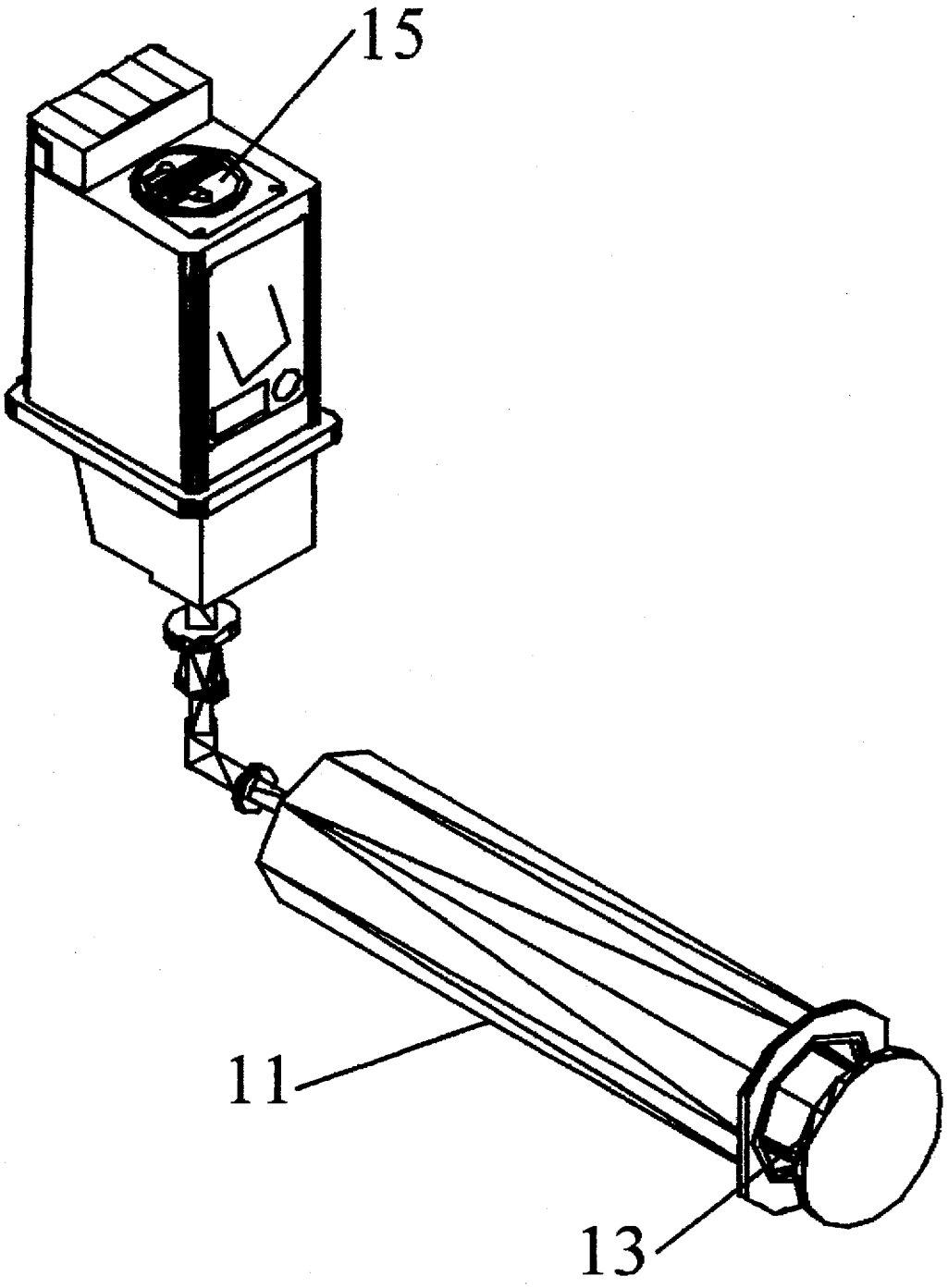
FIG. 3 shows the dispensing of ink into a cartridge reservoir using a syringe.

In FIG. 2 and FIG. 3 shows a filling assembly comprised of apparatus described in FIG. 1 completely attached to a cartridge 20. The cartridge 20 is held such that the ink reservoir vent 15 is in the upright position (highest elevation of the cartridge.) This allows the escape of excess pressure when ink is dispensed into the reservoir of a cartridge. Gently depressing the plunger 13 into syringe 11, causes the ink to flow through the tapered fittings and into the reservoir of a cartridge 20. Tightly sealed connections 7 and 10 provide a leak proof fill path. Some tiny droplets of ink may have formed on the nozzles of the printhead, or on the vent 15. Any ink droplets are wiped away with a soft lint-free cloth.

Figure 4:
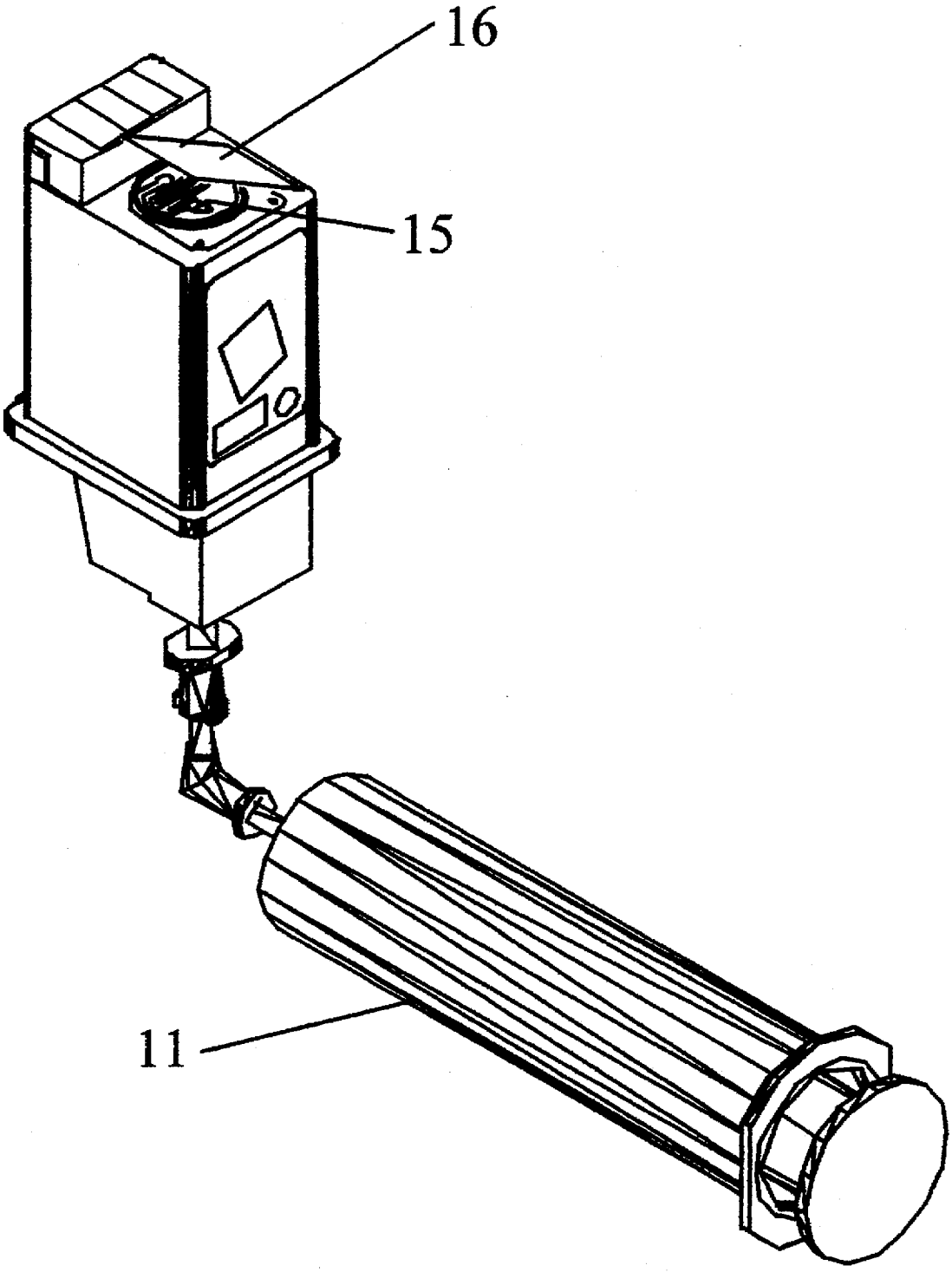
FIG. 4 perspective view of the base of a cartridge and placement of adhesive tape over the reservoir vent, after the filling process.

FIG. 4 shows the placement of an adhesive tape 16 on the reservoir vent 15. After the refill process has taken place, the reservoir vent 15 is wiped clean, and tape 16 is placed to cover the hole. The filling apparatus is then removed from the cartridge 20. Prior to removal, the user may very lightly pull back on the plunger 13 to reduce the chance of ink leakage The components of the filling apparatus can be rinsed with water and stored for repeated use. If there is ink left in the syringe, it can be stored, in the syringe, in a plastic zip type bag, or similar non permeable bag.

Figure 5A:
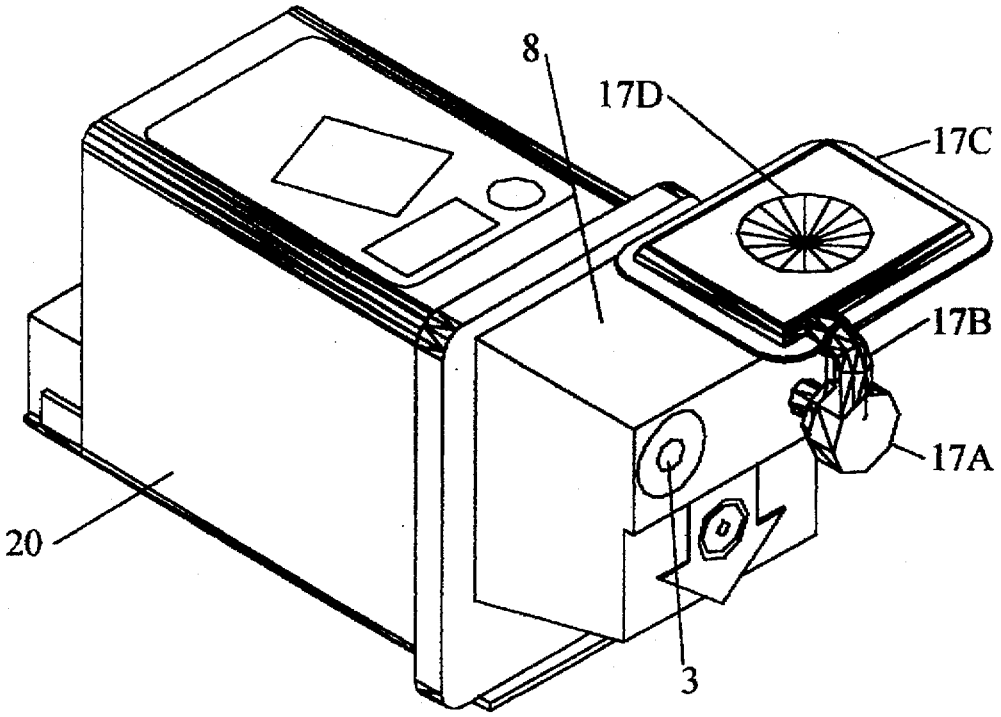
FIG. 5 perspective view of compressing of a negative pressure reservoir and connection of an n.p.r. tube to the fill port of the cartridge using an adapter.
Figure 5B:
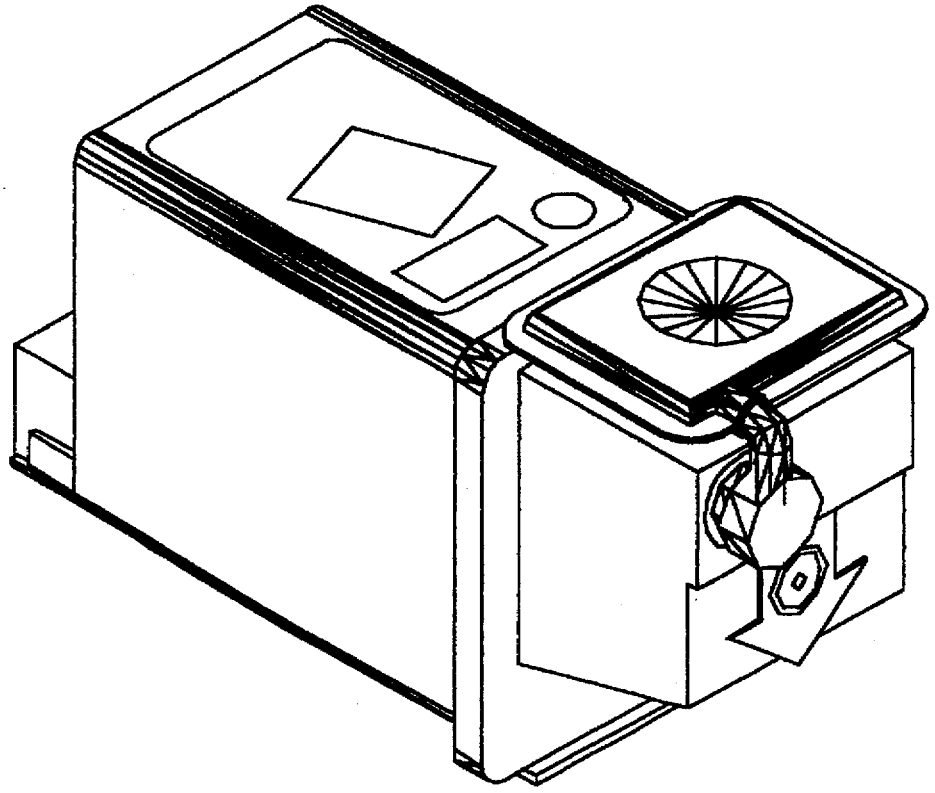

FIG. 5 shows the placement of a negative pressure reservoir assembly 17. The n.p.r. assembly is a product of the assignee of this invention and is completely fabricated and ready for use after the refilling procedure has taken place. A negative pressure reservoir comprises a pad of foam 17D or similar material, encapsulated in a skin 17C of flexible non air-permeable material. A small diameter, semi-rigid tube 17B is sealed into the outer skin 17C and serves as a connection from the fill port of the ink reservoir to a negative pressure reservoir. A reservoir port adapter 17A is a handle of various types of materials uses to easily make the connection between the tube entrance into the fill port and an n.p.r. Alternative components may be used to achieve similar negative pressure reservoirs. Such alternatives include a larger diameter tube, sealed at the end, or a small molded bulb, or any other closed, flexible, non-permeable receptacle, capable of holding a volume and connected to the fill port for means of sustaining a vacuum.

In view 5B, the foam pad 17C of an n.p.r. is compressed as much as possible with the user's fingers (not shown) and held this way while the tube 17B is inserted into the fill port 3 of a cartridge 20. An adapter 17A is used to make this connection easier and provides a stop to limit the length of tube inserted into the fill port. Once the tube 17B is securely inserted into the fill port 3, the n.p.r. may be released.

Figure 6:
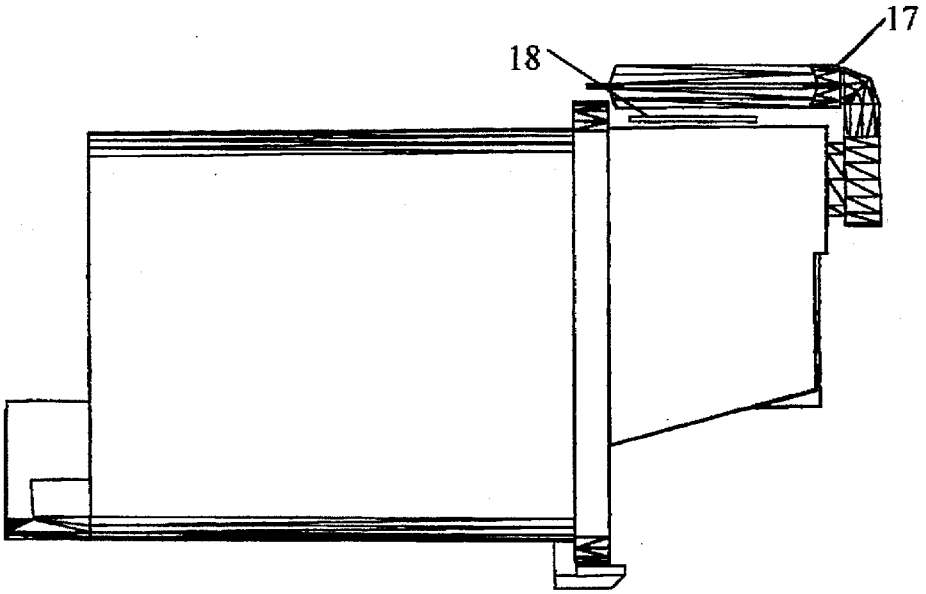
FIG. 6 shows the placement of double faced tape between the n.p.r. and the back face of the top section of the cartridge.

FIG. 6 shows the placement of double faced adhesive tape 18 between the n.p.r. 17 and the back face 8 of the top section 1 of the cartridge 20. The tape 18 is placed and the n.p.r. 17 is depressed against the back face 8 to hold it securely in place.

Figure 7:
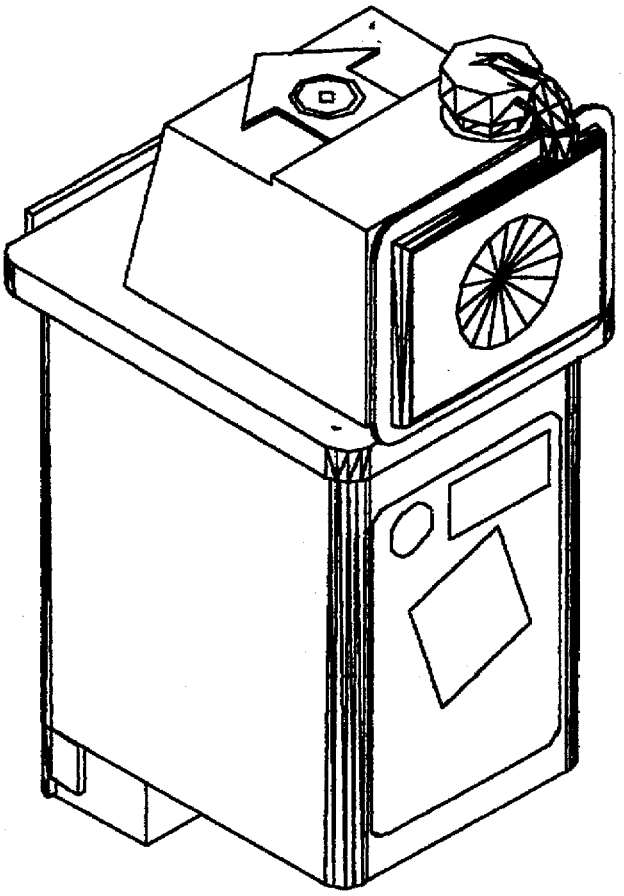
FIG. 7 shows a filled and modified inkier cartridge in its final form.

FIG. 7 shows the refilled and modified inkier cartridge with an n.p.r. 17 in place. The cartridge is ready for use in a printer, after removing the tape 16 from the ink reservoir vent 15. If the refilled, modified cartridge is to be stored for later use, it is recommended that the printhead of the cartridge be covered with a pressure sensitive tape, and stored in a sealed plastic bag or wrapped in foil.

I claim:

1. A method for refilling and inkjet cartridge having an ink reservoir, a vent opening and a fill port, the method comprising:

orienting the ink jet cartridge such that the vent opening is disposed above the fill port;

connecting a fill adapter and elbow connector, having associated tapered Luer connections, in fluid communication with the fill port;

connecting a syringe filled with ink to said elbow connector;

filling the reservoir of the inkjet cartridge with ink from said syringe through the fill port while venting air via the vent opening;

sealing the vent opening with adhesive tape; and removing said fill adapter, elbow connector and syringe from the fill port and connecting a finger actuated negative pressure reservoir to the fill port so as to maintain the filled inkjet cartridge operational prior to use.

2. The method as in claim 1, wherein the fill adapter and elbow connector are comprised of rigid material.

3. The method as in claim 1, wherein the negative pressure reservoir comprises a closed, flexible, non-permeable receptacle filled with foam having a semi-rigid tube connected thereto.

* * * * *